US011805835B2

(12) United States Patent
Lee

(10) Patent No.: US 11,805,835 B2
(45) Date of Patent: Nov. 7, 2023

(54) HAT HAVING HEAD UP PREVENTION FUNCTION

(71) Applicant: Doo Hee Lee, Daegu (KR)

(72) Inventor: Doo Hee Lee, Daegu (KR)

( * ) Notice: Subject to any disclaimer, the term of this patent is extended or adjusted under 35 U.S.C. 154(b) by 24 days.

(21) Appl. No.: 17/607,735

(22) PCT Filed: Mar. 19, 2020

(86) PCT No.: PCT/KR2020/003781
§ 371 (c)(1),
(2) Date: Oct. 29, 2021

(87) PCT Pub. No.: WO2020/222425
PCT Pub. Date: Nov. 5, 2020

(65) Prior Publication Data

US 2022/0202125 A1 Jun. 30, 2022

(30) Foreign Application Priority Data

Apr. 30, 2019 (KR) ..... 10-2019-0050594

(51) Int. Cl.
*A42B 1/24* (2021.01)
*A42B 1/02* (2006.01)
*A63B 69/36* (2006.01)

(52) U.S. Cl.
CPC ..... *A42B 1/24* (2013.01); *A42B 1/02* (2013.01); *A63B 69/3608* (2013.01)

(58) Field of Classification Search
CPC .. A42B 1/24; A42B 1/02; A42B 1/242; A63B 69/3608
(Continued)

(56) References Cited

U.S. PATENT DOCUMENTS 2,717,385 A * 9/1955 Linster ..... A42B 1/247 2/10
3,437,339 A * 4/1969 Starck ..... A63B 69/3608 473/211
(Continued)

FOREIGN PATENT DOCUMENTS

KR 10-0239871 1/2000
KR 20-0392531 Y1 8/2006
(Continued)

OTHER PUBLICATIONS

English machine translation of KR 200428839 Y1. Via espacenet.com. Translation performed on Jan. 19, 2023. (Year: 2006).*

*Primary Examiner* — Jameson D Collier
(74) *Attorney, Agent, or Firm* — Maschoff Brennan

(57) ABSTRACT

The present invention provides a hat which can prevent a golfer's head-up occurring in an actual swing during swing practice or a golf round, and can prevent surroundings causing a hindrance to the swing from coming into the golfer's view so as to enable the golfer to stably swing, so that the golfer can accurately hit a golf ball and increase a driving distance, and can have an excellent shot feeling. The present invention comprises: a holding hole formed in a brim protruding forward from and connected to the cap of a hat; and a gaze-holding member which is fitted in the holding hole, so as to allow the direction of a user's gaze to coincide with a ball and thus enable the user to perform a follow-through action while gazing at the ball until the moment of impact.

1 Claim, 5 Drawing Sheets

(58) Field of Classification Search
USPC ..... 2/209.13, 195.1, 175.1, 10, 15; 473/207, 473/210, 211
See application file for complete search history.

(56) References Cited

U.S. PATENT DOCUMENTS 4,762,325 A * 8/1988 McCleery ..... A63B 69/3608 33/262
5,007,110 A * 4/1991 Gilbert ..... A42B 1/0182 2/919
5,538,250 A * 7/1996 Putz ..... A63B 69/3608 473/409
8,506,100 B2 * 8/2013 Prendamano ..... G02B 7/182 359/881
2004/0078870 A1 * 4/2004 Jones ..... A42B 1/242 2/209.13
2008/0047048 A1 * 2/2008 Kwon ..... A42B 1/0182 2/175.1
2009/0288239 A1 * 11/2009 Lee ..... A42B 1/0183 2/195.1
2010/0064419 A1 * 3/2010 Lee ..... A42B 1/24 2/209.13
2014/0245521 A1 * 9/2014 Johns ..... A42B 1/0182 2/209.13
2015/0181971 A1 * 7/2015 York ..... A42B 1/22 2/209.3

FOREIGN PATENT DOCUMENTS

KR 20-0428839 Y1 10/2006
KR 20-2009-0004534 U 6/2009
KR 10-2010-0053004 A 6/2010
KR 10-2038796 B1 10/2019

* cited by examiner

[FIG. 1]
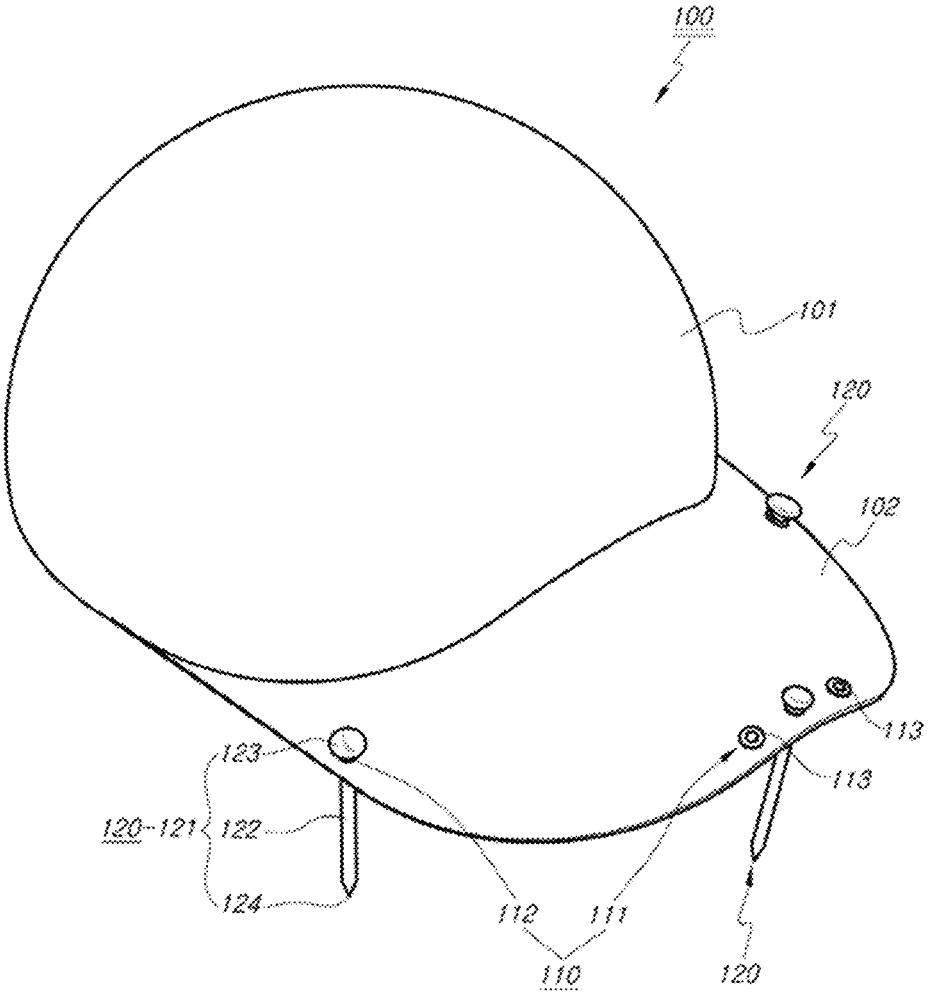

[FIG. 2]
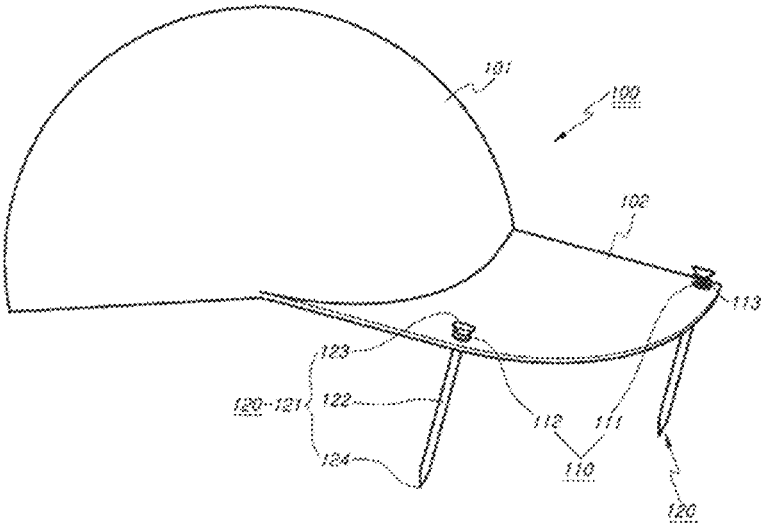
[FIG. 3]
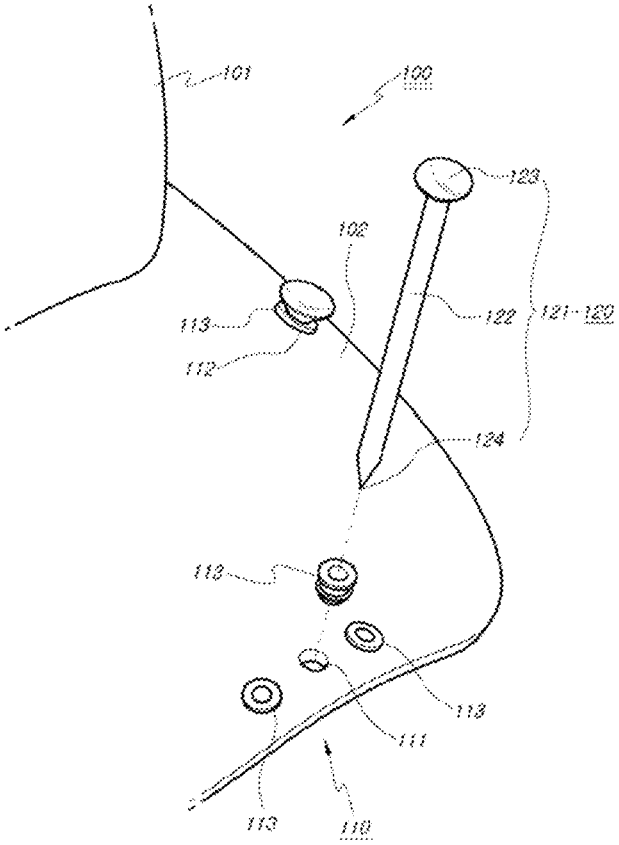

[FIG. 4]
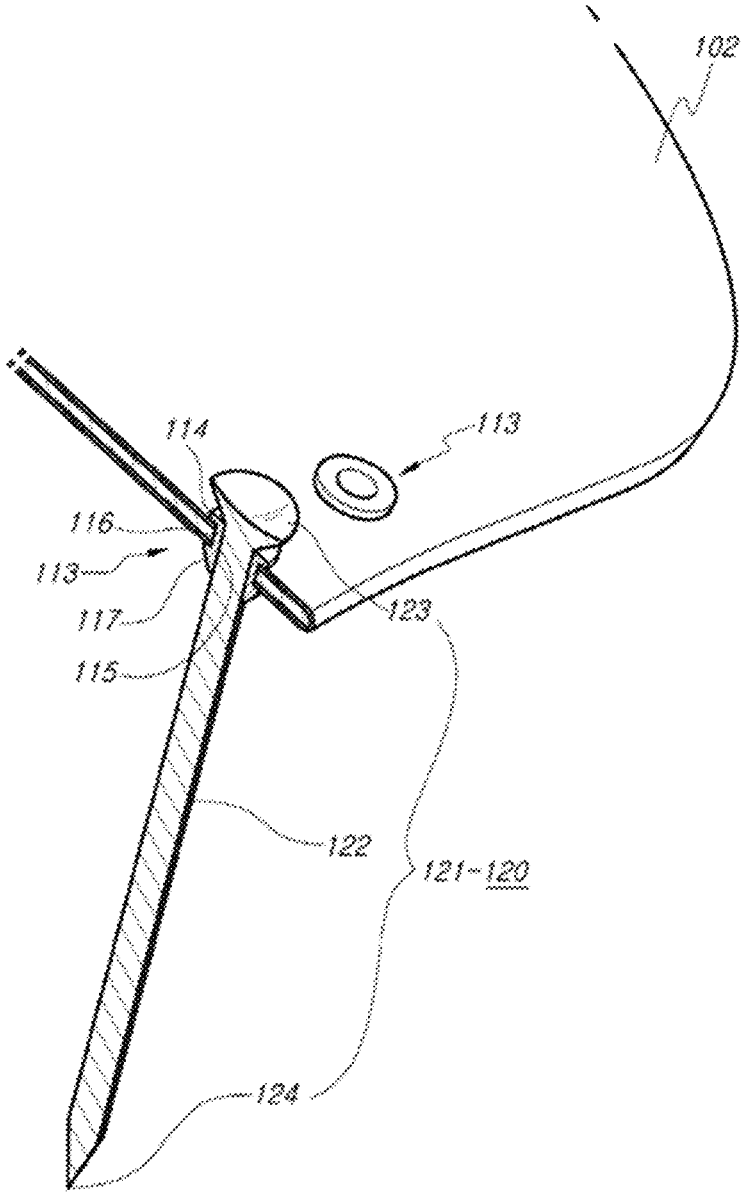

[FIG. 5]
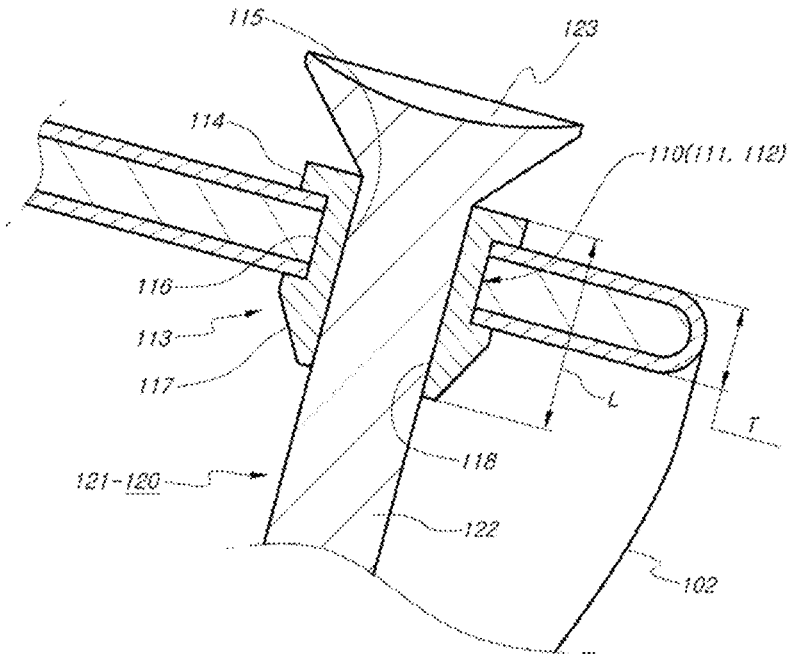
[FIG. 6]
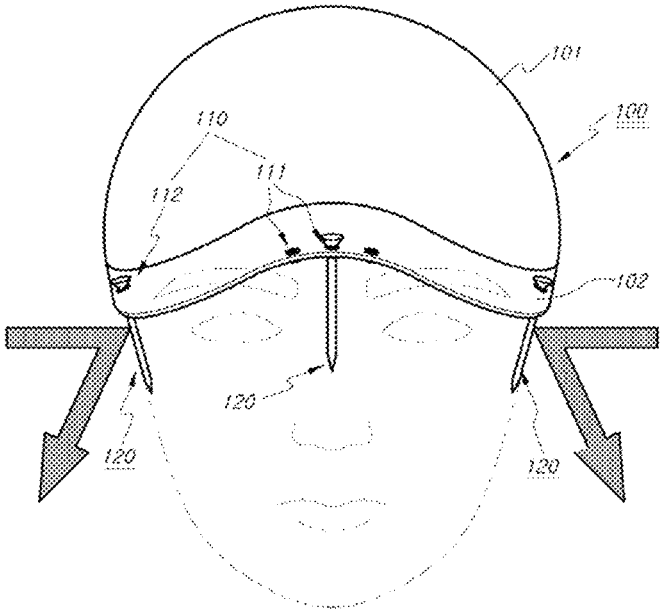

[FIG. 7]
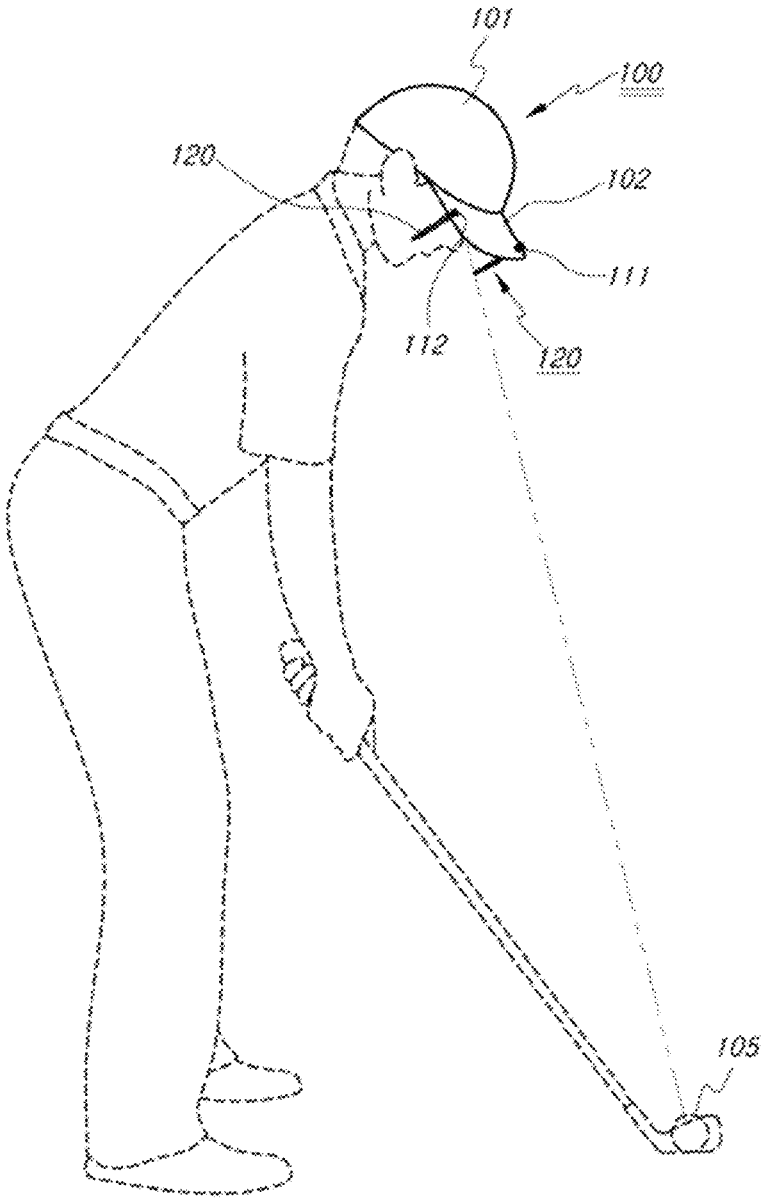

HAT HAVING HEAD UP PREVENTION FUNCTION

FIELD OF INVENTION

Disclosed is a hat which can prevent a golfer's head-up occurring in an actual swing during swing practice or a golf round, and can prevent surroundings causing a hindrance to the swing from coming into the golfer's view so as to enable the golfer to stably swing, so that the golfer can accurately hit a golf ball and increase a driving distance, and can have an excellent shot feeling. The hat includes a holding hole formed in a brim protruding forward from and connected to the cap of a hat; and a gaze-holding member which is fitted in the holding hole, so as to allow the direction of a user's gaze to coincide with a ball and thus enable the user to perform a follow-through action while gazing at the ball until the moment of impact.

BACKGROUND OF INVENTION

In golf, a tee shot is performed using a driver at a tee box, second and third shots or approaches are performed using wood, iron, utility, and wedge clubs to set a ball on a green, and then the ball is input into a hole formed on the green using a putter to finish round one hole, and a player with the lowest number of strokes after round 18 holes wins based on par for the course.

As described above, needless to say, swing of hitting a ball using a golf club needs to be smoothly performed from address to backswing, and from backswing top to lagging, impact, and follow through, and during the swing, it is possible to achieve a straight hit only when a spine angle at address is normally maintained up to the moment of impact.

In addition, even if the spine angle is normally maintained, when head-up in which the head of a user is lifted at the moment of impact occurs, a straight hit is not achieved, and a topped ball whereby an upper part of the ball is hit occurs in a lower part of a head of a club, and thus loss of a driving distance and direction eventually increases the number of strokes.

This is caused by a phenomenon in which a user unconsciously lifts and turns a ball in a direction in which the ball flies or a target direction as well as intention to hit the ball strongly at the moment of striking the ball or before striking the ball.

Conventionally, to prevent such head-up, various methods have been devised in the patent documents as follows.

A golf hat having a visor disclosed in Patent Document 1 (Korean Utility Model publication No. 20-0336122) includes:

an indicator lamp 12 installed in an inner central side of a visor 11 of a golf hat 10 to emit light of a color laser light source; a supporter 13 installed above the indicator lamp 12 to fix the visor 11 of the golf hat 10; and a switch 14 for turning on/off the color laser light source at one side of a body of the indicator lamp 12, thereby preventing head-up of a golf practicer during swing.

In Patent Document 2 (Korean Patent Publication No. 10-0239871), a head-up detection device body 1 is coupled to a hat 12 of a golfer, and includes an electronic switch 7 operated by a sound amplifier 6 of a microphone 5 coupled to a sound reflector 4 for detecting a hit sound 2 of a golf ball 3, and a message generator 9 connected to a position switch 8 for detecting an inclined position of the head, and a speaker 10, and in this case, a circuit is operated by a battery 11.

SUMMARY OF INVENTION

Technical Problem to be Solved

Among the above prior arts, in Patent Document 1 (Korean Utility Model publication No. 20-0336122), an indicator lamp is installed in a visor of a hat, a golf ball is irradiated with light, and whether head-up occurs is determined according to whether the golf ball is irradiated with light at the moment of impact, and in Patent Document 2 (Korean Patent Publication No. 10-0239871), a position switch is turned on at an address position, a hit sound of a ball is received to generate a message in a normal case, and no sound is generated when head-up occurs, and accordingly whether head-up occurs is checked.

In the above Patent Documents, a separate device needs to be installed to detect head-up, and thus the device is required every round, and if the device is not ready, it is not possible to check whether head-up occurs during an actual round, disadvantageously.

Before round, a user needs to always know whether power required for an operation of the device is charged, and when the user does not know if the device is charged, even if the device is ready, it is frequently impossible to actually use the device, it is cumbersome to prepare an auxiliary device as well as basic equipment required for playing a round of golf, and an economic burden occurs depending on the condition and type of the device.

If the user focuses on light and sound to prevent head-up, the user is not able to focus on a correct swing that the user needs to be paying attention to, and thus although head-up is prevented, the ball is not hit normally and the back ground is hit, and even if follow-through needs to be smoothly switched from the moment of impact, a phenomenon such as severe hook frequently occurs due to awkward follow-through, and it is difficult to send the ball in a target direction normally, thereby problematically leading to loss of a driving distance.

In addition to the above head-up detection device, visor films that protrude downward are integrally formed with both sides of a visor of a hat or are detachably formed thereon using tongs, etc. to prevent head-up as a simple device, but in a process of practical use, the device is not frequently used and is not of practical help due to inconvenience and hassle.

Technical Solution

Therefore, to overcome the above problem, the present invention provides a hat having a head-up prevention function including: a maintenance hole 110 formed in a visor 102 connected to a front side of a cap 101 of a hat 100 to protrude therefrom; and a gaze maintainer (120) coupled to the maintenance hole 110 and matching gaze of a user with a ball 105 to allow a follow-through motion while watching the ball 105 to the end until a moment of impact.

A stable swing may be achieved by preventing head-up and also blocking surrounds that interrupt the swing from entering a visual field during practice or actual swing in round, thereby advantageously improving hitting sense as well as improving a straight hit and increasing a driving distance.

Effect of Invention

According to the present invention, head-up may be prevented using a hat required for round and a golf tee used to place a ball for tee shot at a tee box, thereby preventing inconvenience of having to provide additional goods or equipment by a user.

According to the present invention, head-up may be prevented using golf equipment that a user always carries while having a simple structure, thereby providing various effects of improving the game by simply preventing head-up while reducing an economic burden of having to buy a separate device.

BRIEF DESCRIPTION OF DRAWINGS

FIG. 1 is a perspective view showing a hat having a head-up prevention function to which the spirit of the present invention is applied.

FIG. 2 is a cross-sectional view of a hat having a head-up prevention function, taken along a line A-A, to which the spirit of the present invention is applied.

FIG. 3 is an exploded perspective view of a main part of a hat of a head-up prevention function to which the spirit of the present invention is applied.

FIG. 4 is a partial perspective view formed by extracting a main part of a hat having a head-up prevention function to which the spirit of the present invention is applied.

FIG. 5 is a cross-sectional view of a main part of a hat having a head-up prevention function to which the spirit of the present invention is applied.

FIG. 6 is a wearing state diagram of a hat having a head-up prevention function to which the spirit of the present invention is applied.

FIG. 7 is another wearing state diagram of a hat having a head-up prevention function to which the spirit of the present invention is applied.

BEST MODE

According to an exemplary embodiment of the present invention, a hat having a head-up prevention function includes a maintenance hole 110 formed in a visor 102 connected to a front side of a cap 101 of a hat 100 to protrude therefrom, and a gaze maintainer 120 coupled to the maintenance hole 110 and matching gaze of a user with a ball 105 to allow a follow-through motion while watching the ball 105 to the end until a moment of impact.

The maintenance hole 110 includes one or more gaze maintenance holes 111 formed in a front side of a central part of the visor 102; and gaze blocking holes 112 formed at both sides of the visor 102 to block both sides from entering a visual field.

A maintenance hole holder 113 is coupled to each of the gaze maintenance hole 111 and the gaze blocking holes 112 to stably maintain the gaze maintainer 120 even if the gaze maintainer 120 is frequently coupled to and detached from the gaze maintenance hole 111 and the gaze blocking holes 112.

The maintenance hole holder 113 further includes: a flange 114 caught on a top of the maintenance hole 110; a holder body 116 having a maintainer hole 115 into which the gaze maintainer 120 is inserted; a projection 117 formed on an outer side to be caught by a lower side of the maintenance hole 110 below the holder body 116; and an extension 118 formed to have the maintainer hole 115 having a greater length L than a thickness T of the visor 102 to stably catch the gaze maintainer 120.

Mode for Invention

Hereinafter, the exemplary configuration and operation of the present invention for achieving the above object will be described with reference to the accompanying drawings.

FIG. 1 is a perspective view showing a hat having a head-up prevention function to which the spirit of the present invention is applied, FIG. 2 is a cross-sectional view of a hat having a head-up prevention function, taken along a line A-A, to which the spirit of the present invention is applied, FIG. 3 is an exploded perspective view of a main part of a hat of a head-up prevention function to which the spirit of the present invention is applied, FIG. 4 is a partial perspective view formed by extracting a main part of a hat having a head-up prevention function to which the spirit of the present invention is applied, FIG. 5 is a cross-sectional view of a main part of a hat having a head-up prevention function to which the spirit of the present invention is applied, FIG. 6 is a wearing state diagram of a hat having a head-up prevention function to which the spirit of the present invention is applied, and FIG. 7 is another wearing state diagram of a hat having a head-up prevention function to which the spirit of the present invention is applied, all of which will be described together.

A hat 100 having a head-up prevention function to which the spirit of the present invention is applied may include a maintenance hole 110 formed in a visor 102 connected to a front side of a cap 101 to protrude therefrom, and a gaze maintainer 120 coupled to the maintenance hole 110 and matching user gaze with a ball 105 to allow a follow-through motion while watching the ball 105 to the end until the moment of impact.

The maintenance hole 110 may include one or more gaze maintenance holes 111 formed in a front side of a central part of the visor 102, and gaze blocking holes 112 formed at both sides of the visor 102 to block both sides from entering a visual field.

The gaze maintenance hole 111 and the gaze blocking hole 112 may be configured in such a way that a through hole is directly formed in the visor 102, but a maintenance hole holder 113 may be further coupled to each of the gaze maintenance hole 111 and the gaze blocking hole 112 to prevent the gaze maintainer 120 from being stably maintained due to an increased diameter of each of the gaze maintenance hole 111 and the gaze blocking hole 112 in a process of frequently coupling and detaching the gaze maintainer 120.

The maintenance hole holder 113 may be formed of a material such as rubber, urethane, or silicone to be easily coupled to the maintenance hole 110 and to also increase adhesion with the gaze maintainer 120, and may include a flange 114 caught on the top of the maintenance hole 110, and a holder body 116 having a maintainer hole 115 into which the gaze maintainer 120 is inserted.

Needless to say, the maintenance hole holder 113 may be formed in a metal eyelet type as well as formed of a material such as rubber, urethane, or silicone.

An extension 118 may be integrally formed with a lower part of the holder body 116 to have the maintainer hole 115 having a greater length L than a thickness T of the visor 102 to stably catch the gaze maintainer 120 while having the projection 117 on an outer side to be caught by a lower side of the maintenance hole 110.

The gaze maintainer 120 may include a head inserted into and caught by the maintenance hole 110 and a maintainer body having a bar type, but according to the present invention, a tee 121 that is necessarily used in golf may be inserted into the maintenance hole 110, thereby removing inconvenience of having to provide a separate item.

That is, as the tee 121 having a ball accommodation part 123 at a top of a bar type tee body 122 and an insert tip 124 at a bottom thereof, a short tee having a small length, a middle tee having a middle length, or a long tee having a long length may be selected by a user, may be coupled to the maintenance hole 110, and may be used depending on a user body type, a type of a used club, etc.

The state of use of the hat 100 having a head-up prevention function to which the present invention is applied will be described below.

In order to use a head-up prevention function, the gaze maintainer 120 may be coupled to the maintenance hole 110 formed in the visor 102 prior to wearing the hat 100, and then when swing is performed in the state in which a user wears the hat 100, the state in which user gaze is matched with the ball 105 may be maintained through the gaze maintainer 120 until the moment of impact, and thus head-up may be prevented to achieve a straight hit, to increase a driving distance, to send a ball straight to a target, and to improve hitting sense through stable swing.

In more detail, when the tee 121 for golf as the gaze maintainer 120 (it is possible to couple and use a short tee, a middle tee, or a long tee depending on user selection, but a long tee may be advantageous because the user is capable of visually checking the tee while looking at the ball) is coupled to the maintenance hole 110 formed in the front side of the central part of the visor 102, the user may be capable of checking an end of the tee 121 while looking at the ball 105.

As such, the user may recognize that head-up has not occurred when both of the ball 105 and the tee 121 enter a visual field during backswing and downswing, and at the moment of impact from an address position, and may recognize that head-up has occurred when the tee 121 disappears from the visual field at the moment of impact.

The above method may be possible during a process of actually hitting the ball 105 in round as well as practice swing, and thus correct swing may be enabled and the ball 105 may be accurately hit to increase a driving distance, to maintain a correct ball direction, and to improve hitting sense through stable swing.

A central maintenance hole of the plurality of maintenance holes 110 formed in the front side of the central part of the visor 102 may be used to process the gaze during swing using an iron club, and a maintenance hole formed on the right side of the center among the maintenance holes 110 may be used when the head needs to be positioned slightly to the right during swing using a long club such as a driver, a wood, or a utility club.

Thus, it may be possible to select a maintenance hole among the maintenance holes 110 and to couple the selected maintenance hole to the gaze maintainer 120 for a draw chip that gently curves to the left from a hitting point or a fade chip that curves gently to the right from the hitting point depending on a chip that a user wants to send the ball 105 by hitting the ball 105 as well as a type of a club that the user uses.

When coupled to the maintenance holes 110 formed in both sides of the visor 102, the gaze maintainer 120 may perform a function of blocking surround scenery or objects, companions, etc. from entering a visual field in a process of swinging after taking an address position, and thus the user may only focus on the ball 105 and the gaze maintainer 120 coupled to the maintenance hole 110 formed in the front side of the central part of the visor 102, and head-up may be prevented to achieve correct swing and hitting.

According to the present invention, sway in which a lower body moves significantly may be advantageously prevented in a process of switching to backswing from an address position to contribute to a stable swing, and putting ability may also be advantageously improved by extending the arm in a direction of a target to send a ball to the target while maintaining a stable and constant stroke and holding the head at the position of the ball in a putting process.

According to the present invention, since movement of the head may be held strongly, a user may easily practice maintaining the head at the position of a ball temporarily at the moment of impact or after impact, and thus the body may be prevented from being lifted up and the head may also be prevented from being lifted up by preventing the right foot from being lifted from the floor early, thereby enabling a strong and straight swing due to the effect of extending the arms while maintaining the position of the head.

As described above, according to the present invention, a stable swing may be achieved by preventing head-up and also blocking surrounds that interrupt the swing from entering a visual field during practice or actual swing in round, thereby advantageously improving hitting sense as well as improving a straight hit and increasing a driving distance.

The invention claimed is:

1. A hat having a head-up prevention function, the hat comprising:

a visor;

a hat dome;

a plurality of maintenance holes formed in the visor, the visor connected to a front side of the hat dome to protrude from the hat dome; and three gaze maintainers adapted to be respectively coupled to any one of the plurality of maintenance holes and configured to match a gaze of a user with a ball to allow a follow-through motion while the user watches the ball until a moment of impact occurs between the ball and a club during a swing, each of the three gaze maintainers being a tee having a ball accommodation part at a top of a rod-shaped tee body and an insert tip at a bottom of the rod-shaped tee body, wherein the plurality of maintenance holes include:

at least one gaze maintenance hole formed in a front side of a central part of the visor; and two gaze blocking holes respectively formed at each of two lateral sides of the visor to block both of the lateral sides from entering a visual field of the user;

wherein a maintenance hole holder is respectively coupled to each of the plurality of maintenance holes to stably hold the gaze maintainers even if the gaze maintainers are frequently coupled to and detached from the plurality of maintenance holes; and wherein each of the maintenance hole holders further includes:

a flange caught on a top of the respective maintenance hole;

a holder body having a maintainer hole into which the respective gaze maintainer is inserted;

a projection formed on an outer side and caught by a lower side of the respective maintenance hole below the holder body; and an extension formed to provide the maintainer hole with a length that is greater than a thickness of the visor to stably catch the respective gaze maintainer.

* * * * *